US007162768B1

(12) United States Patent
Gartner

(10) Patent No.: US 7,162,768 B1
(45) Date of Patent: Jan. 16, 2007

(54) ENLARGED PAINT ROLLER

(75) Inventor: Perry Gartner, Englewood, NJ (US)

(73) Assignee: Brenner International Corp, Englewood, NJ (US)

( * ) Notice: Subject to any disclaimer, the term of this patent is extended or adjusted under 35 U.S.C. 154(b) by 194 days.

(21) Appl. No.: 10/709,887

(22) Filed: Jun. 3, 2004

(51) Int. Cl.
*B05C 17/02* (2006.01)

(52) U.S. Cl. ..... 15/230.11; 492/13; 492/19

(58) Field of Classification Search ..... 15/230.11, 15/176.1; 492/13, 19
See application file for complete search history.

(56) References Cited

U.S. PATENT DOCUMENTS 5,806,131 A * 9/1998 Tennant ..... 15/230.11
6,671,919 B1 * 1/2004 Davis ..... 15/167.1

* cited by examiner

*Primary Examiner*—Mark Spisich
(74) *Attorney, Agent, or Firm*—Richard A Joel, Esq.

(57) ABSTRACT

An enlarged paint roller assembly comprises a curved yoke with a central recess for connection to a handle with frame portions extending at a downward slope from the recess on both sides thereof. The frame portions include downwardly extending end arms which include a plurality of prong-like portions which engage the apertures in detachable frame arms member having inwardly extending protrusions. A roller cap includes an aperture at each end which is engaged by the inwardly extending protrusions to and resilient protrusions which engage arm support a large roller therebetween.

4 Claims, 4 Drawing Sheets

17b
2-2
45a
19c
20c
47b
21c
51
29b
46
18b
19d
35b
31b
21d
22b
11
16b 10
15
14
12
25
35
13
50
16a
18a
20a
45a
19a
17a
46
2-2
19b

ENLARGED PAINT ROLLER

BACKGROUND OF INVENTION

This invention relates to paint rollers which accommodate roller assemblies in a yoke frame. The curved frame includes end arms which extend downwardly from the yoke frame at each end to engage frame arms which include elements protruding inwardly from each end. Plastic bearings are mounted over the protruding elements which also serve as end caps for the roller.

In the prior art, the roller connection or bearing was rather small compared to the present invention and included a narrow surface about which the roller rotated. Consequently, when considerable pressure was placed upon the roller, the roller was forced out of the bearings and the roller fell down from the frame. This could cause considerable damage or inconvenience when the roller was wet with paint. Applicant is proposing an invention wherein the roller will withstand severe forces applied thereto without becoming dislodged while painting takes place. This is very important particularly when using enlarged rollers of 12 inches or more which require the application greater force against a surface.

In the prior art, the roller bearing comprised a flange on an upwardly protruding plastic cylinder and a narrow end cap which engaged the flange surface. When considerable axial pressure was applied to the roller handle, the roller fell outwardly from the bearings. This problem is eliminated with the present invention wherein a protruding end bearing element extends outwardly from the frame arm to positively engage an aperture in a large roller cap. A typical wire frame and cage assembly is shown in U.S. Pat. No. 5,345,648 to Graves.

SUMMARY OF INVENTION

This invention relates to an enlarged paint roller assembly which includes a curved yoke frame having a central recess with a threaded insert for a handle and a downwardly curved frame portion on each side of the recess. The frame portions each terminate in an end arm having downwardly extending resilient prongs. The prongs each engage the apertures in a frame arm which includes an upper recessed portion with side apertures corresponding to the prongs. The resiliently biased prongs spring outwardly to become locked in the apertures. A lower portion of the frame arm comprises a cylindrical portion having a two-step protrusion extending inwardly to engage a roller end cap. The enlarged roller is mounted between opposing protrusions. The frame portions are substantially inflexible as pressure is applied to the handle and the protrusions provide a positive engagement with apertures in the roller cap to prevent disengagement of the roller.

Accordingly, an object of this invention is to provide a new and improved enlarged paint roller which includes a yoke frame having a frame arm with a protruding bearing surface to be engaged by an end cap on a paint roller and is capable of withstanding greater forces without the roller becoming dislodged.

Another object of this invention is to provide a new and improved enlarged paint roller of 12 inches or more which withstands high pressures applied to the handle for applying all kinds of paint and coatings particularly heavy bodied coatings.

A more specific object of this invention is to provide a new and improved enlarged paint roller frame which includes a curved bracket or frame with an intermediate threaded insert for connection to a handle and a downwardly extending frame arm at each end of the bracket having end members coupled thereto, to removably engage respective frame arms which include inwardly protruding portions to engage the end caps in a roller.

A further object of this invention is to provide a new and improved large paint roller which includes a central recess on a curved yoke frame for connection to a handle, curving frame portions on both sides of the central recess terminating in end members having downwardly extending prongs to resiliently engage a frame arm having protrusions extending inwardly to engage the end caps on a roller.

BRIEF DESCRIPTION OF DRAWINGS

The above and other objects and advantages of this invention may be more clearly seen when viewed in conjunction with the accompanying drawings wherein.

FIG. 3 is a view of the frame arm end cap and roller; and.

DETAILED DESCRIPTION

Figure 1:
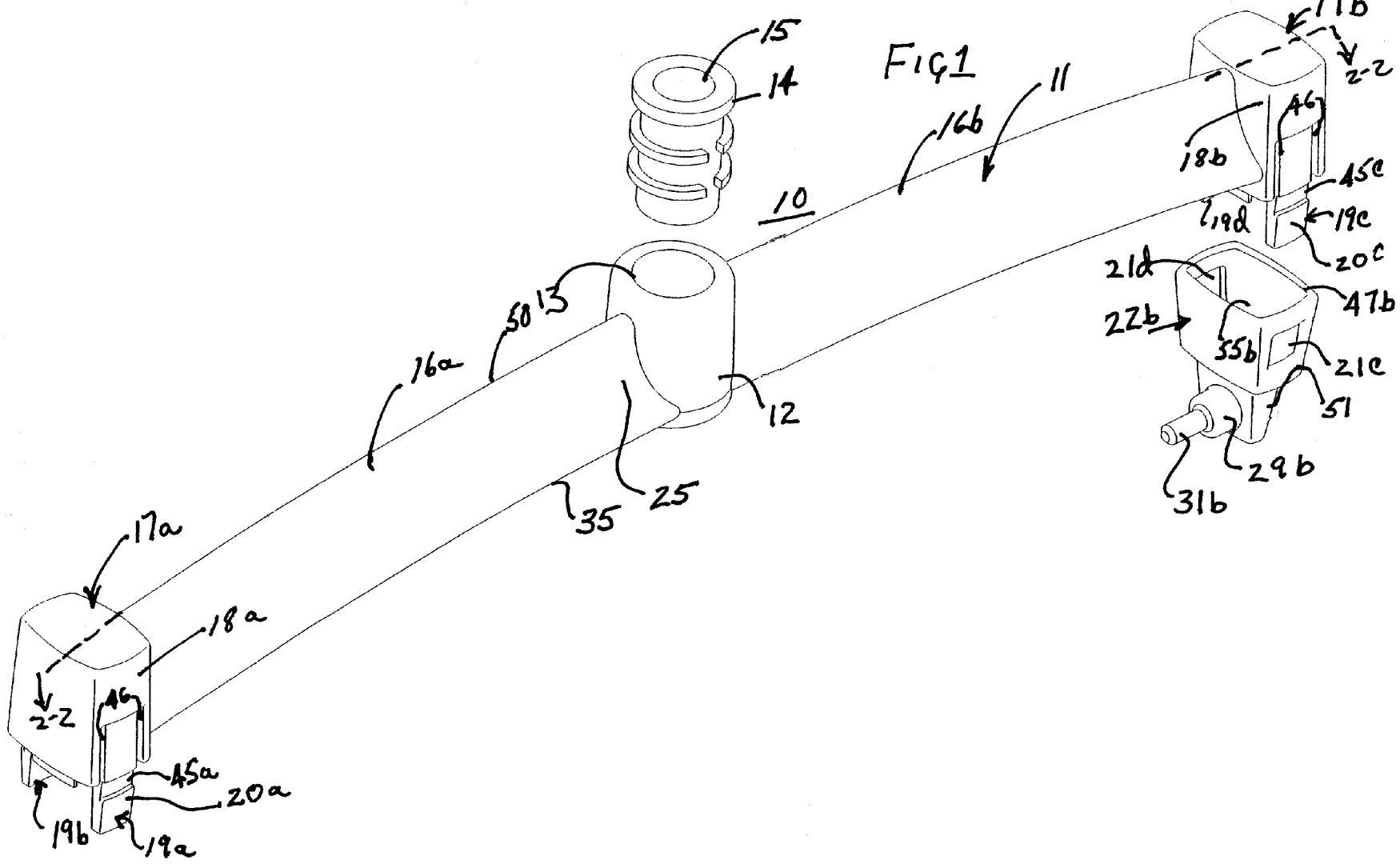
FIG. 1 is an exploded perspective view of the invention with only one of the frame arms shown for purposes of illustration.
Figure 2:
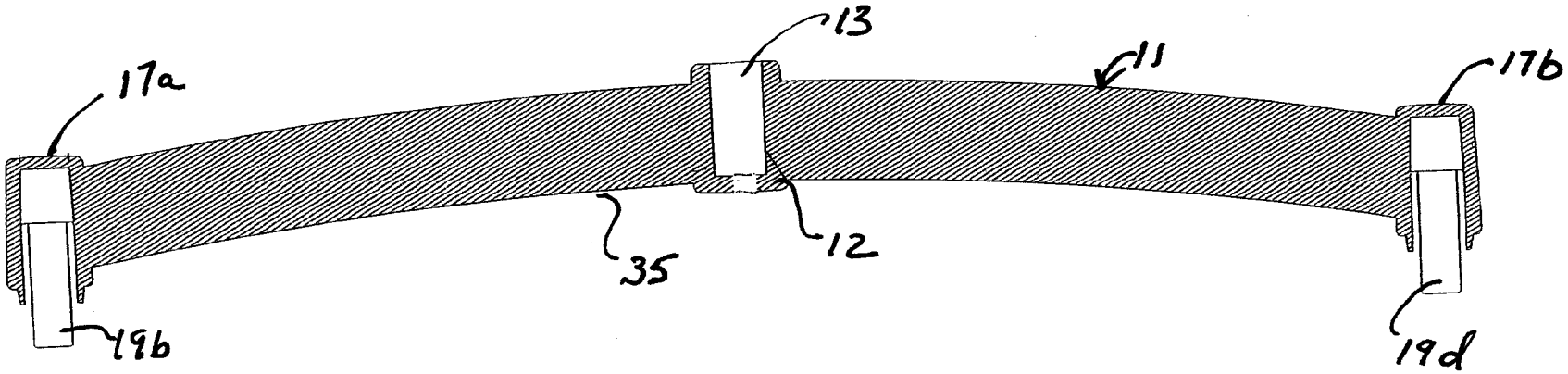
FIG. 2 is a cross-sectional view of the yoke frame taken along the line 2—2 of FIG. 1.

Referring now to the FIG. 1 of the drawings, the invention comprises a paint roller assembly 10 which may extend up to eighteen inches or more in length. The roller assembly includes a curved yoke frame 11 with a central substantially cylindrical intermediate portion 12 having an upper recess 13 which accommodates a threaded insert 14. The insert 14 is mounted within the recess 13 with epoxy cement. A handle (not shown) is threaded into the recess 15 to use the roller assembly 10 for painting purposes.

The yoke frame 11 comprises downwardly curved frame portions 16*a*, 16*b* on each side of the cylindrical center portion 12. The frame portions 16*a*, 16*b* have a narrow rounded upper surface 50 and outwardly curving concave walls 25 which slope downwardly to an enlarged base 35. This design provides considerable strength to the frame 11 and permits increased forces to be applied to the roller 40. The frame members 16*a*, 16*b* terminate at integrally molded end arms 17*a*, 17*b* which include upper portions 18*a*, 18*b* and downwardly extending opposing prongs 19*a*, 19*b*, and 19*c*, 19*d* which are separated from the main portion of the arms 18*a*, 18*b* by narrow slots 46.

The prongs 19*a*–*d* are resilient and include a recess 45*a*–*d* and outwardly extending protrusions 20*a*, 20*b* and 20*c*, 20*d* which engage respective apertures 21*a*, 21*b* and 21*c*, 21*d* in the frame arms 22*a*, 22*b*. The frame arms 22*a*, 22*b* snap onto the prongs 20*a*, 20*b* and 20*c* and 20*d* respectively to form a unitary structure. The apertures 21*a*, 21*b*, and 21*c*, 21*d* in the arms 22*a* and 22*b* are substantially rectangular in configuration along the curved wall 51. The upper arm portion 47*a* and 47*b* include a recess 55*a*, 55*b* into which the prongs 19*a*–*c* are inserted.

The frame arms 22*a*, 22*b* include an upper substantially rectangular portion 47*a*, 47*b* with transverse wall apertures 21*a*, 21*b*, 21*c*, and 21*d* which engage the downwardly extending prong protrusions 20*a*–*d* in said apertures. A lower downwardly extending lower portion 51 includes a larger cylindrical protrusion 29*a*, 29*b* extending transversely inward and protrusion or bearing 31*a*, 31*b* at the end thereof which is smaller in diameter but longer.

Figure 3:
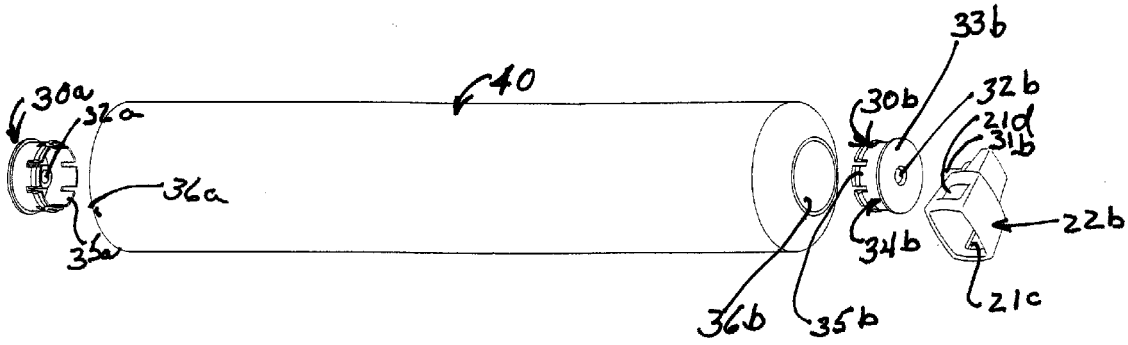
Figure 4B:
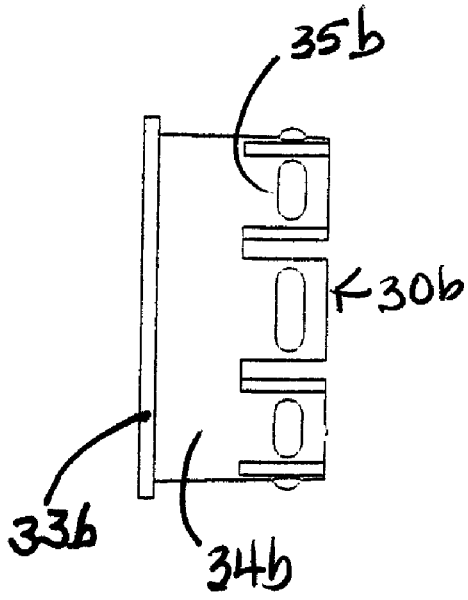
FIGS. 4*a* and 4*b* depict the roller end cap in an end view and side view respectively.
Figure 4A:
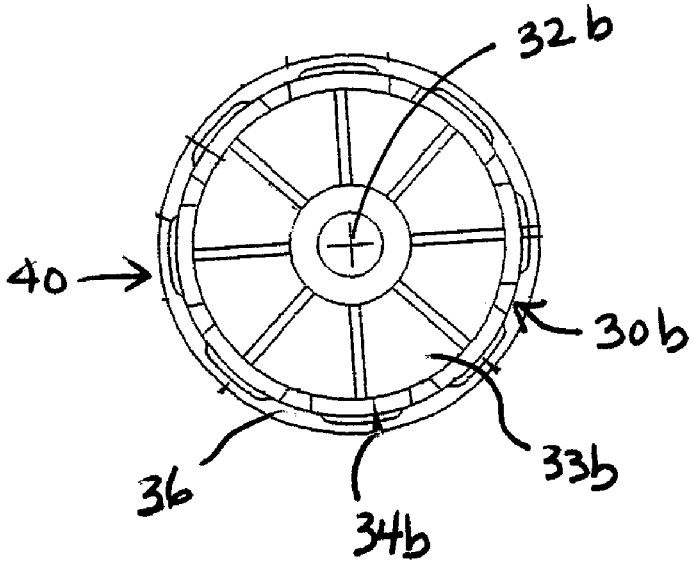

The end protrusions 31*a*, 31*b* (see FIG. 3) engage respective apertures 32*a*, 32*b* in the roller end caps 30*a*, 30*b*. The end caps 30*a*, 30*b* include an end surface 33*a*, 33*b* with the apertures 32*a*, 32*b* and a main body 34*a*, 34*b* terminating in outwardly extending flexible prongs 35*a*, 35*b*. The end caps 30*a*, 30*b* are force fitted into respectively apertures 36*a*, 36*b* in the roller 40.

Since the end protrusions 31*a*, 31*b* are longer and more secure in the caps 30*a*, 30*b* than conventional designs, the roller assembly 10 can withstand up to three times the pressure of conventional assemblies without the roller 40 becoming dislodged. The curved yoke also assists in the pressure forces are not diverted perpendicular to the yoke. With large rollers 40, eighteen inches one greater, greater pressure is applied to the roller 40 with the handle in order to cover a surface with paint from the roller 40. The present invention makes larger rollers feasible so that a greater surface may be covered with each movement of the roller.

In operation, a handle (not shown) is threaded into the aperture 15. The frame arm inserts 22*a*, 22*b* are then snapped onto the end arms 17*a*, 17*b* with the prongs 19*a*–*d* locking the inserts 22*a*, 22*b* within apertures 21*a*–21*d*. An end cap 30*a*, 30*b* is inserted into the opening 36*a*, 36*b* of roller 40 and held therein by flexible prongs 35*a*, 35*b*. The protruding bearing 31*a*, 31*b* is then inserted into the apertures 32*a*, 32*b* in the end caps 30*a*, 30*b*. The enlarged roller 40 which may be eighteen inches in length or even greater is now ready for painting. The roller may have been considerable force applied thereto without becoming loose or falling out of the yoke 11.

While the invention has been explained by a detailed description of certain specific embodiments, it is understood that various modifications and substitutions can be made in any of them within the scope of the appended claims which are intended also to include equivalents of such embodiments.

The invention claimed is:

1. An enlarged paint roller comprising:

a yoke frame having a central cylindrical portion and downwardly extending curved frame portions on each side thereof;

an arm extending downwardly at the end of each frame portion, said frame arms each including a pair of opposed resilient prongs extending downwardly therefrom, said arm further having fixed opposite portions extending downwardly and forming a recess therebetween;

a frame arm having apertures on opposite ends thereof to engage the downwardly extending prongs and inwardly extending bearing protrusions to engage a paint roller; and wherein, the arm at the end of each frame portion includes an upper portion, an intermediate portion having opposing prongs extending downwardly, a pair of side portions, said prongs being spaced to predetermined distance form the side portions imparting flexibility to the prongs.

2. An enlarged paint roller in accordance with claim 1 wherein:

the prongs each include elongated substantially rectangular members having an indentation thereon to grip the end frame arms and outwardly extending transverse portions to engage the aperture in the frame arms.

3. An enlarged paint roller in accordance with claim 1 wherein:

the protrusions of the frame arms comprise a first cylindrical portion projecting inwardly and a second cylindrical portion extending from the first cylindrical portion to form a bearing surface to engage a roller.

4. An enlarged paint roller in accordance with claim 1 wherein:

the prongs each include downwardly extending upper portion, and intermediate recess and a lower outwardly projecting portion.

* * * * *